US008701295B2

(12) United States Patent
Clearman

(10) Patent No.: US 8,701,295 B2
(45) Date of Patent: Apr. 22, 2014

(54) VARIABLE PRESSURE CUTTING DEVICES

(76) Inventor: Joseph Clearman, Poulsbo, WA (US)

( * ) Notice: Subject to any disclaimer, the term of this patent is extended or adjusted under 35 U.S.C. 154(b) by 396 days.

(21) Appl. No.: 12/947,161

(22) Filed: Nov. 16, 2010

(65) Prior Publication Data

US 2011/0119931 A1 May 26, 2011

Related U.S. Application Data

(60) Provisional application No. 61/263,243, filed on Nov. 20, 2009.

(51) Int. Cl.
*B26B 3/00* (2006.01)
*B26B 27/00* (2006.01)
*B26B 29/06* (2006.01)

(52) U.S. Cl.
USPC ..... 30/294; 30/280

(58) Field of Classification Search
USPC ..... 30/278, 280, 283, 293, 294
See application file for complete search history.

(56) References Cited

U.S. PATENT DOCUMENTS

| | | | | |
|---|---|---|---|---|
| 609,486 | A | 8/1898 | Wilson | |
| 838,852 | A | 12/1906 | Eckley | |
| 1,265,139 | A | 5/1918 | Tittle, Jr. | |
| 1,621,008 | A | 3/1927 | Fricker | |
| 2,238,678 | A * | 4/1941 | Cook | 30/294 |
| 2,266,916 | A | 12/1941 | Steele | |
| 2,597,540 | A * | 5/1952 | Smith | 30/156 |
| 2,814,111 | A | 11/1957 | Jones | |
| 3,448,519 | A * | 6/1969 | Tobias | 30/293 |
| 3,550,838 | A | 12/1970 | Hart | |
| 3,613,241 | A | 10/1971 | Allen | |
| 3,678,581 | A | 7/1972 | Bolduc | |
| 3,939,533 | A | 2/1976 | Benepe | |
| D264,689 | S | 6/1982 | Miller | |
| 4,414,717 | A | 11/1983 | Payne | |
| 521,115 | A | 6/1984 | Hopper | |
| D276,596 | S | 12/1984 | Kisha | |
| 4,631,829 | A | 12/1986 | Schmidt et al. | |
| 4,656,697 | A | 4/1987 | Naslund | |
| D299,008 | S | 12/1988 | Naslund | |
| 4,833,956 | A * | 5/1989 | Roberts | 83/56 |
| D301,548 | S | 6/1989 | Weaver | |
| 4,847,956 | A | 7/1989 | Levine | |
| 4,887,335 | A | 12/1989 | Folkmar | |
| 5,329,728 | A | 7/1994 | Ray | |
| 5,379,489 | A | 1/1995 | Delk et al. | |
| D363,453 | S | 10/1995 | Herdt | |
| D375,045 | S | 10/1996 | Weber et al. | |
| 5,619,775 | A | 4/1997 | Klinck | |
| 5,713,108 | A | 2/1998 | Solomon et al. | |
| 5,737,842 | A | 4/1998 | Freedman | |
| 5,881,463 | A * | 3/1999 | Casteel et al. | 30/280 |

(Continued)

*Primary Examiner* — Hwei C Payer
(74) *Attorney, Agent, or Firm* — Orrick, Herrington & Sutcliffe LLP

(57) ABSTRACT

An embodiment includes a cutting device having a blade; a device architecture configured to hold the blade that includes: a pressure body operable to remain rigid in response to a substrate pressing against a portion of the pressure body at a first pressure, and a portion of the pressure body operable to deform in response to the substrate pressing against a portion of the pressure body at a second pressure, and thereby provide variable resistance against the substrate; and, a cutter slot at a first device architecture end defined by the blade and the pressure body, the cutter slot configured to receive the substrate and operable to open rearwardly toward a second end as the pressure body deforms.

10 Claims, 17 Drawing Sheets

(56) References Cited

U.S. PATENT DOCUMENTS

| | | | | |
|---|---|---|---|---|
| 5,921,601 | A | 7/1999 | Buckles | |
| D423,353 | S | 4/2000 | Blanchard et al. | |
| 6,371,844 | B1 * | 4/2002 | Holler | 452/132 |
| 6,457,218 | B1 | 10/2002 | Lawrence | |
| 6,571,477 | B1 * | 6/2003 | Mothena et al. | 30/115 |
| 6,629,327 | B2 | 10/2003 | Adams | |
| 6,886,982 | B2 | 5/2005 | Reynolds | |
| 7,131,169 | B2 | 11/2006 | Folkmar | |
| 8,176,640 | B2 * | 5/2012 | Gullicks et al. | 30/294 |
| 8,316,493 | B2 * | 11/2012 | Clearman | 7/158 |
| 2006/0184187 | A1 | 8/2006 | Surti | |
| 2007/0245571 | A1 * | 10/2007 | Pearson | 30/294 |

* cited by examiner

VARIABLE PRESSURE CUTTING DEVICES

PRIORITY CLAIM

This application claims the benefit of U.S. Provisional Application No. 61/263,243 filed on Nov. 20, 2009, which application is incorporated herein by reference in its entirety for all purposes.

TECHNICAL FIELD

This disclosure relates generally to cutting tools, and more specifically, to systems and methods for providing variable pressure cutting devices.

BACKGROUND

Various hand-held cutting devices are known in the art including knives, cutters, letter-openers, and the like. For example, Design Pat. No. 329,584 depicts a hand-held letter-opener that has an elongated slot with an internally mounted blade for cutting. Design Pat. Nos. 329,798 and 333,773 depict similar letter-openers.

While such letter-openers are capable of cutting envelopes, and the like, such devices have various deficiencies and often they are not suitable to cut a wide range of materials. Materials being cut may be cut by the same small portion of the blade, which makes the device inoperable when this portion of the blade dulls.

For example, attempting to cut a substrate 190 such as cardboard with a letter-opener fails to cut the material, and the material merely ends up wedged in the end of the cutting slot. While some cutters with a similar configurations are operable to cut stronger materials such as cardboard or plastics, these same devices typically have difficulty cutting soft or weak materials such as paper.

Additionally, although scissors may have the ability to cut a wider range of materials, scissors nonetheless require substantially more dexterity and strength to create cuts. Specifically, a user must use several fingers to manipulate the scissor blades, manually select an appropriate cutting force, and must direct the scissors at the same time.

Moreover, scissors are inherently dangerous because they may include sharp points at the ends of the scissor blades, and the cutting region is open and exposed. The pointed scissor blades or the open cutting region may accidently puncture or cut a person or undesired substrates.

BRIEF DESCRIPTION OF THE DRAWINGS

The present disclosure will be presented by way of exemplary embodiments, but not limitations, illustrated in the accompanying drawings in which like references denote similar elements, and in which.

DETAILED DESCRIPTION

Illustrative embodiments presented herein include, but are not limited to, systems and methods for providing variable pressure cutting devices.

Various aspects of the illustrative embodiments will be described using terms commonly employed by those skilled in the art to convey the substance of their work to others skilled in the art. However, it will be apparent to those skilled in the art that the embodiments described herein may be practiced with only some of the described aspects. For purposes of explanation, specific numbers, materials and configurations are set forth in order to provide a thorough understanding of the illustrative embodiments. However, it will be apparent to one skilled in the art that the embodiments described herein may be practiced without the specific details. In other instances, well-known features are omitted or simplified in order not to obscure the illustrative embodiments.

The phrase "in one embodiment" is used repeatedly. The phrase generally does not refer to the same embodiment; however, it may. The terms "comprising," "having" and "including" are synonymous, unless the context dictates otherwise.

The following figures depict several embodiments of a variable pressure cutting device according to various embodiments. Various embodiments include a pressure body opposing a blade edge, which defines a cutter slot, wherein various substrates 190 can be cut as such substrates 190 are forced into the cutter slot. The cutter slot, in various embodiments, provides resistance to the substrate 190 being forced into the cutter slot, which may cause the pressure body to move and thereby provide more or less resistance to the substrate 190 being cut. Accordingly, in some embodiments, a reverse-scissoring motion may be created, which may increase cutting efficacy. As discussed herein, a substrate 190 may be various materials, but may include paper, cardboard, plastic, product containers, metal, and the like.

Figure 1A:
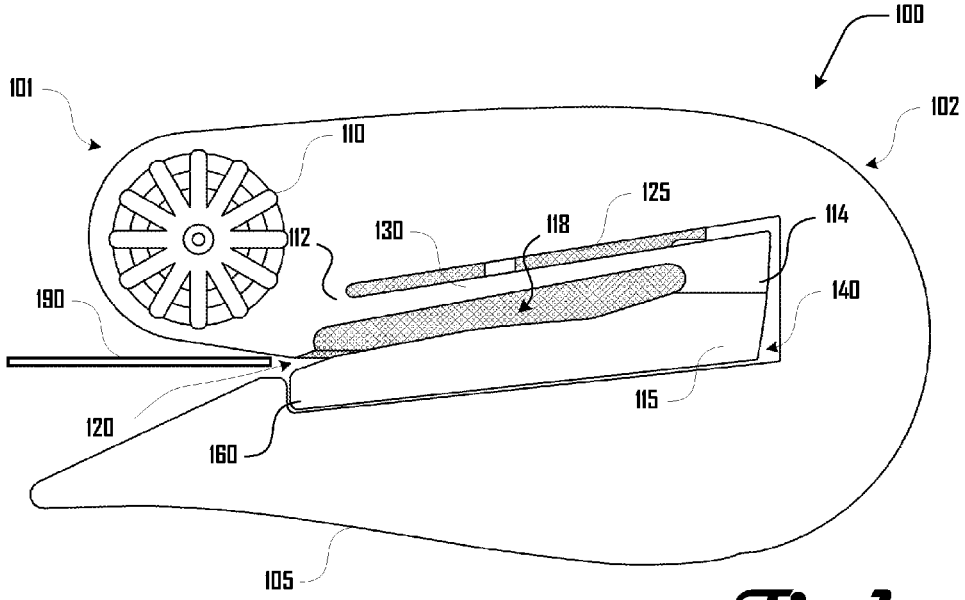
FIG. 1*a* is a pictorial diagram of a variable pressure cutting device, in accordance with various embodiments.
Figure 1B:
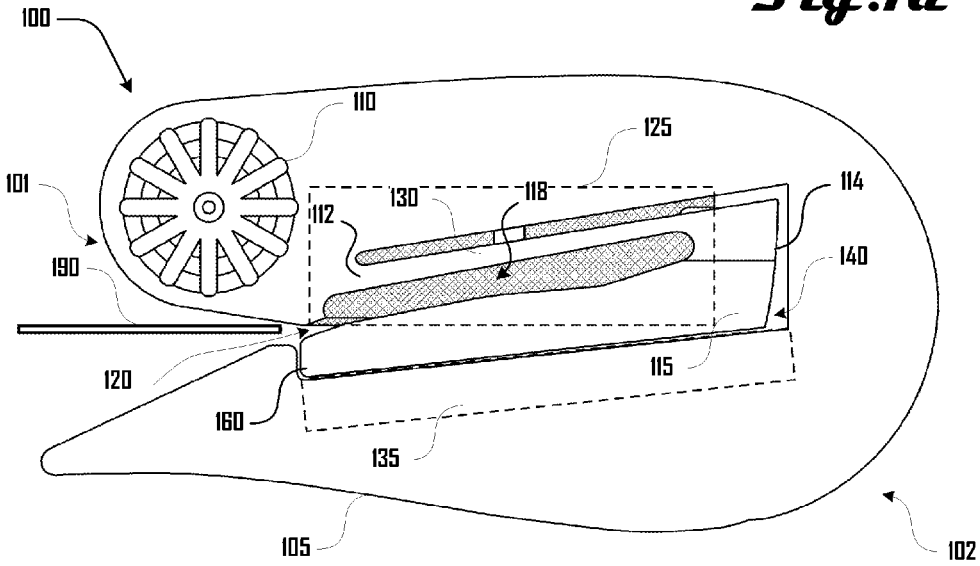
FIG. 1*b* is a pictorial diagram of a variable pressure cutting device including hidden lines, in accordance with various embodiments.

FIG. 1*a* is a pictorial diagram of a variable pressure cutting device 100, in accordance with various embodiments and FIG. 1*b* is a pictorial diagram of the variable pressure cutting device 100, including hidden lines depicting a blade 125 (and a cavity lower portion 135), in accordance with various embodiments. In various embodiments a blade may be a razor blade, knife blade, material edge, and the like.

As shown in FIGS. 1*a* and 1*b*, the variable pressure cutting device 100 comprises generally a device architecture 105, which holds a blade 125. The device architecture 105 comprises a grip 110, a pressure body 115, and a cutter slot 120, which is defined by the blade 125 and the pressure body 115. The pressure body 115 further comprises a spring extension 130 and a pressure arm 160. The device architecture defines an upper cavity 140 and a lower cavity 135 in which the pressure body 115 may extend and move therein. In some embodiments, the pressure body 115B may be configured as depicted in FIG. 1*g*.

Figure 1C:
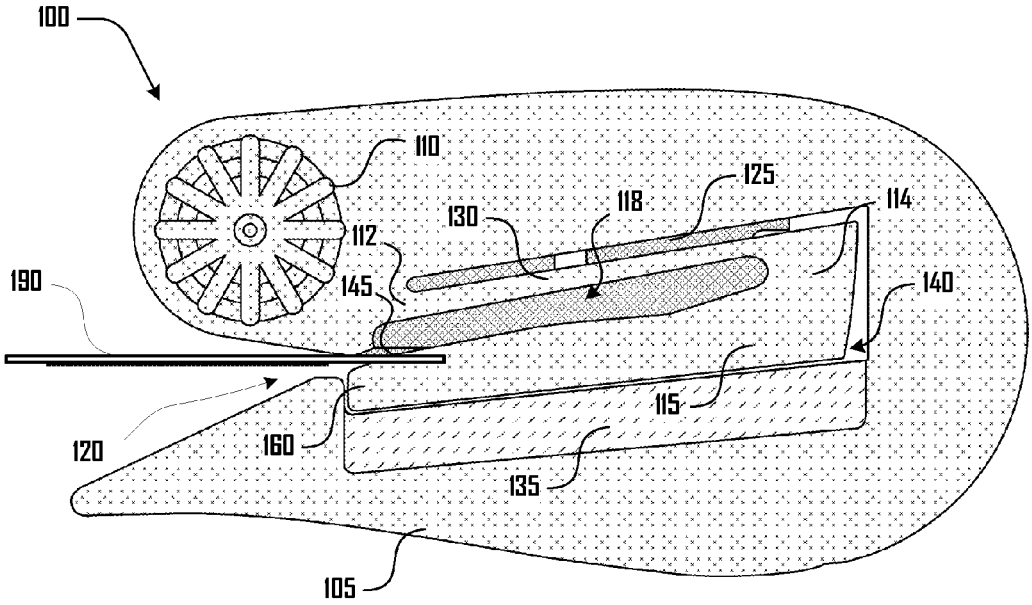
FIG. 1*c* is a cross section diagram of a variable pressure cutting device in a first cutting position, in accordance with various embodiments.

As shown in FIGS. 1*c-f*, the variable pressure cutting device 100 is operable to cut a substrate 190 while assuming various configurations. Four exemplary cutting configurations are depicted in FIGS. 1*c-f*. As illustrated in FIG. 1*c*, a substrate 190 that a user desires to cut is inserted into the cutter slot 120 defined by the blade 125 and the pressure body 115. A substrate 190 inserted into the cutter slot 120 comes in contact with the blade edge 145 and a pressure arm 160 of the pressure body 115. Depending on the substrate 190, the substrate 190 may be cut by the blade edge 145 and pressure arm 160, and the pressure arm 160 may move to accommodate variable cutting force required to cut a given substrate 190.

Figure 1D:
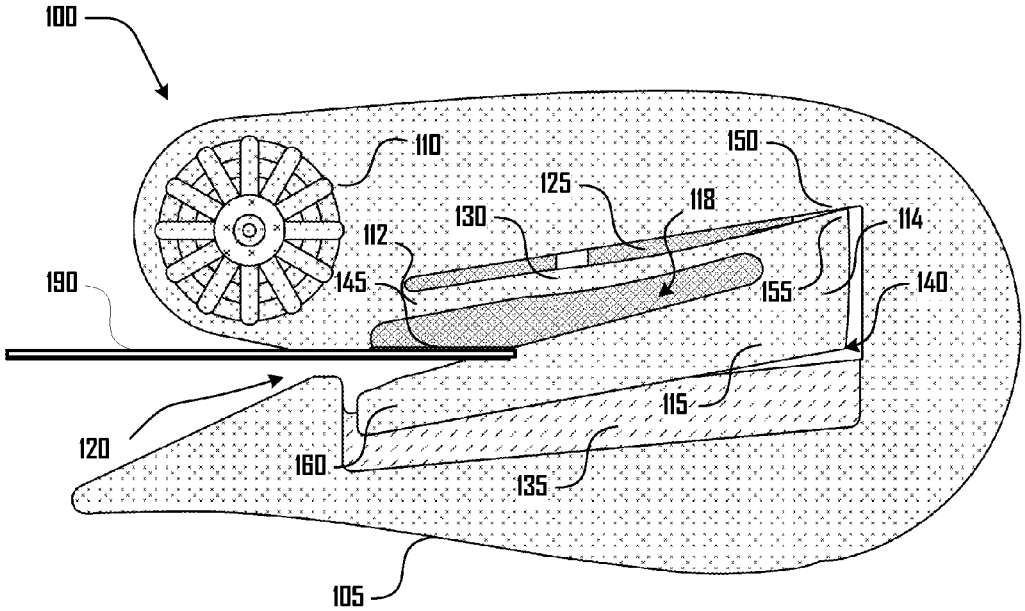
FIG. 1*d* is a cross section diagram of a variable pressure cutting device in a second cutting position, in accordance with various embodiments.

In FIG. 1*d*, if the substrate 190 is not cut or fully cut by the blade edge 145 with the pressure arm 160 in the first cutting configuration as shown in FIG. 1*c*, or if additional pressure is required to cut the substrate 190, the pressure arm 160 is operable to bend into the cavity lower portion 135, whereby the cutter slot 120 opens rearwardly, as depicted in FIG. 1*d*, to allow the substrate 190 to extend therein. As the cutter slot 120 opens rearwardly, a pressure body upper corner 155 moves into contact with a contact point 150 of cavity 140 to arrest further upward movement of the pressure arm 160. The spring extension 130 may flex, bend, or compress and may introduce pressure between blade edge 145 and pressure arm 160 when under force by a substrate 190, and may also flex, bend, or compress to facilitate movement of the pressure arm 160.

Figure 1E:
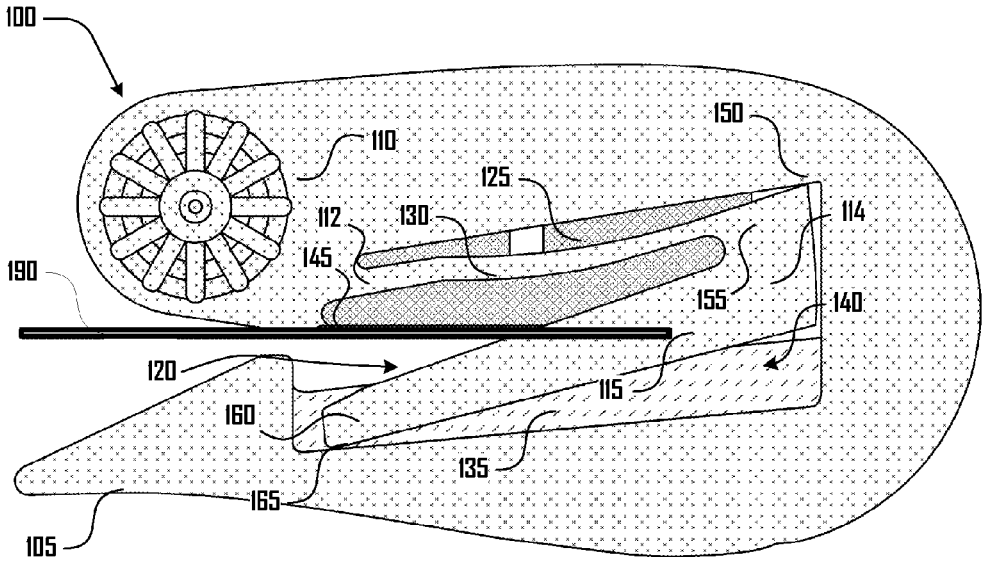
FIG. 1*e* is a cross section diagram of a variable pressure cutting device in a third cutting position, in accordance with various embodiments.
Figure 1F:
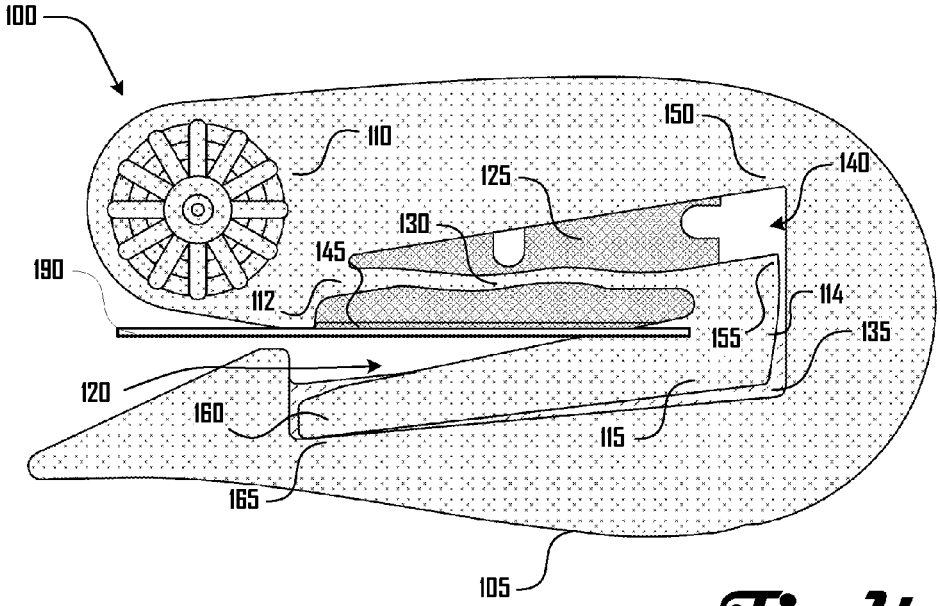
FIG. 1*f* is a cross section diagram of a variable pressure cutting device in a fourth cutting position, in accordance with various embodiments.
Figure 1G:
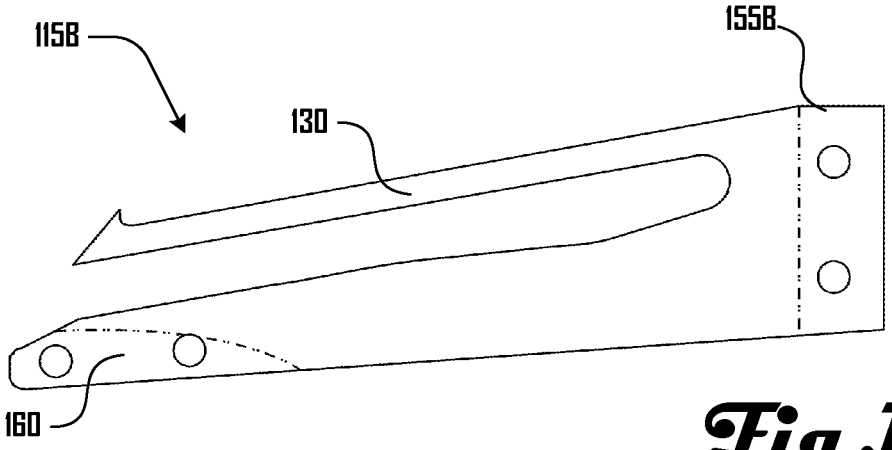
FIG. 1*g* is a side view of a pressure body in accordance with one embodiment.

In some embodiments, the pressure body 115B may be configured as depicted in FIG. 1*g*, and comprise a pressure body upper corner 155B, which is flattened or rounded to correspond to a contact portion 150 of the upper wall cavity 140.

In FIG. 1*e*, if the substrate 190 is not cut or fully cut by the blade edge 145 and pressure arm 160 in the second cutting configuration as shown in FIG. 1*d*, or if additional pressure is required to cut the substrate 190, the pressure arm 160 is operable to rotate into the cavity lower portion 135, whereby the cutter slot 120 opens further rearwardly. As the cutter slot 120 opens rearwardly, the pressure body upper corner 155 pivots against a upper wall 150, which allows the pressure arm 160 to move into the cavity lower portion 135, and contact a lower pivot point 165. The spring extension 130 may further flex, bend, rotate or compress and may introduce pressure between blade edge 145 and pressure arm 160 when under force by a substrate 190, and may also flex, bend, or compress to facilitate further movement of the pressure arm 160.

In FIG. 1*f*, if the substrate 190 is not cut or fully cut by the blade edge 145 and pressure arm 160 in the third cutting configuration as shown in FIG. 1*e*, or if additional pressure is required to cut the substrate 190, the pressure arm 160 is operable to rotate into the cavity lower portion 135, whereby the cutter slot 120 opens further rearwardly. As the cutter slot 120 opens rearwardly, the pressure body 115 pivots against the lower pivot point 165, which allows the pressure arm 160 to move further into the cavity lower portion 135. The spring extension 130 may further flex, bend, or compress and may introduce pressure between blade edge 145 and pressure arm 160 when under force by a substrate 190, and may also flex, bend, or compress to facilitate further movement of the pressure arm 160.

Accordingly, as shown in FIGS. 1*c-f*, the pressure arm 160 may assume various configurations to allow the cutter slot 120 defined by the blade edge 145 and pressure arm 160 to open rearwardly to accommodate cutting a substrate 190 that requires variable pressure to cut the substrate 190, to accommodate the cutting force requirements of various substrates 190, and the like. In various embodiments, each successive configuration of the cutting device 100 cutting slot 120 may introduce increasing pressure on a substrate 190.

For example, a substrate 190 such as paper or tissue paper may require less pressure for cutting and the force generated in the cutter slot 120 in the first configuration depicted in FIG. 1*c* may be sufficient to cut the paper or tissue paper without triggering further configurations (i.e. additional pressure). However, a substrate 190 such as cardboard may require substantial pressure and may thereby cause the cutting device 100 to assume the second, third and/or fourth configurations (as depicted in FIGS. 1*d-f* respectively) to provide adequate pressure.

In various embodiments, it may be desirable to allow cutting at different positions along the blade edge 145 because the blade edge 145 may thereby retain its overall sharpness and cutting efficacy longer because different portions of the blade edge 145 are used depending on cutter slot 120 configuration. Moreover, substrates 190 are more likely cut on sharper portions of the blade edge 145 because a less sharp portion of the blade edge 145 may cause sufficient resistance to cause the cutter slot 120 to assume a configuration which allows the substrate 190 to be cut at a sharper portion at a more rearward position of the blade edge 145.

In one embodiment, a variable pressure cutting device 100 includes blade 125; a device architecture 105 configured to hold the blade 125 that includes: a pressure body 115 operable to remain rigid in response to a substrate 190 pressing against a portion of the pressure body 115 at a first pressure, and a portion of the pressure body 115 operable to deform in response to the substrate 190 pressing against a portion of the pressure body 115 at a second pressure, and thereby provide variable resistance against the substrate 190; and, a cutter slot 120 at a first device architecture end 101 defined by the blade 125 and the pressure body 115, the cutter slot 120 configured to receive the substrate 190 and operable to open rearwardly toward a second end 102 as the pressure body 115 deforms.

The pressure body 115 may comprise a spring extension 130 and a pressure arm 160 defining the cutter slot 120 in combination with the blade 125. The spring extension 130 may extend from a portion of the device architecture at a first spring extension end 112 and the pressure arm 160 may extend from a second spring extension end 114. The spring extension 130 and the pressure arm 160 may define a pressure body slot 118.

Figure 2:
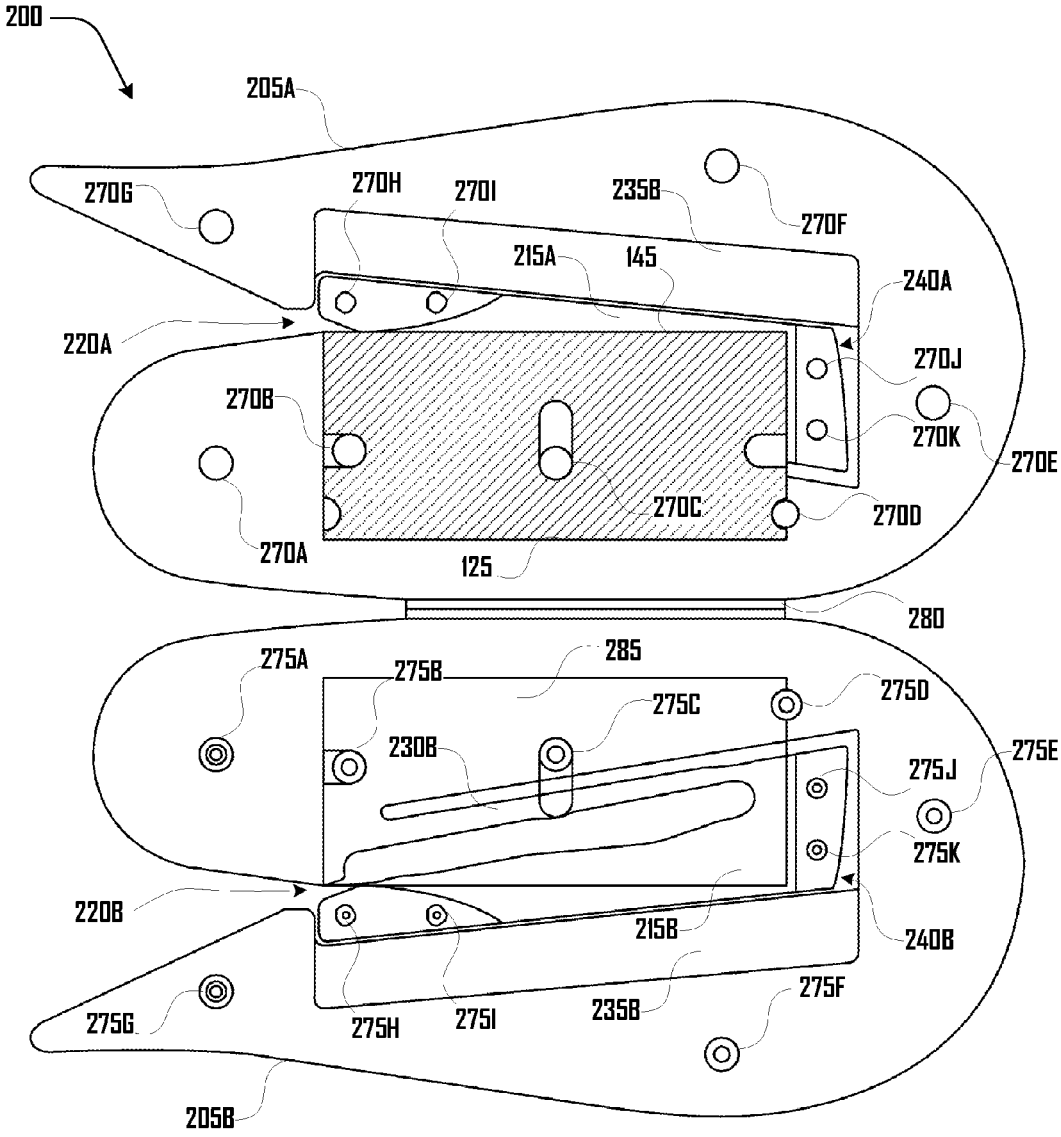
FIG. 2 is pictorial diagram of a first and second half of a one-piece variable pressure cutting device in a first cutting position, in accordance with various embodiments.

The cutting device 100 depicted in FIGS. 1*a*-1*f* may be manufactured in a variety of ways and may therefore be configured in various ways to optimize manufacturing cost, material use, and manufacturing time. For example, FIG. 2 is an open body pictorial diagram of a first and second half 205A, 205B of a one-piece variable pressure cutting device 200 in a first cutting position, in accordance with various embodiments. The one-piece variable pressure cutting device 200 may be analogous to the cutting device 100 depicted in other Figures, when folded about its central axis or folding axis 280.

As shown in FIG. 2 the one-piece variable pressure cutting device 200 comprises a first and second half 205A, 205B, which are joined by the folding axis 280. The first half 205A includes a plurality of coupling slots 270, which correspond to a plurality of coupling pins 275 on the second half 205B. For example, coupling slot 270A corresponds to coupling pin 275A, and coupling pin 275A would reside within coupling slot 270A when the first and second half 205A, 205B are folded together.

To allow a blade 125 to reside between the first and second side 205A, 205B, the second side 205B includes a blade depression 285. The blade depression 285 may be present in one or both of the first and second side 205A, 205B, and the blade depression 285 may be present on portions of the first and/or second pressure body 215A, 215B. In various embodiments, the blade depression 285 may form a cavity that fits various sizes and shapes of blades with varying snugness.

Some coupling pins 275 may be positioned to hold a blade 125. For example, as shown in FIG. 2, a second, third, and fourth coupling pins 270B, 270C, 270D are positioned to hold a common blade 125. Positions of coupling pins 270 may be altered to facilitate holding of various shapes, sizes, and configurations of blades 125.

Additionally, the one-piece variable pressure cutting device 200 includes elements analogous to those of the cutting device 100 depicted in previous FIGS. 1*a-f*. For example, there is a first and second cavity lower portion 235A, 235B, a first and second upper wall of the cavity 240A, 240B, a first and second pressure body 215A, 215B, a first and second cutter slot 220A, 220B, and the like. In various embodiments, other embodiments of a cutting device (e.g. as depicted in subsequent figures) may be manufactured or embodied in such a half-and-half configuration as depicted in FIG. 2.

Figure 3A:
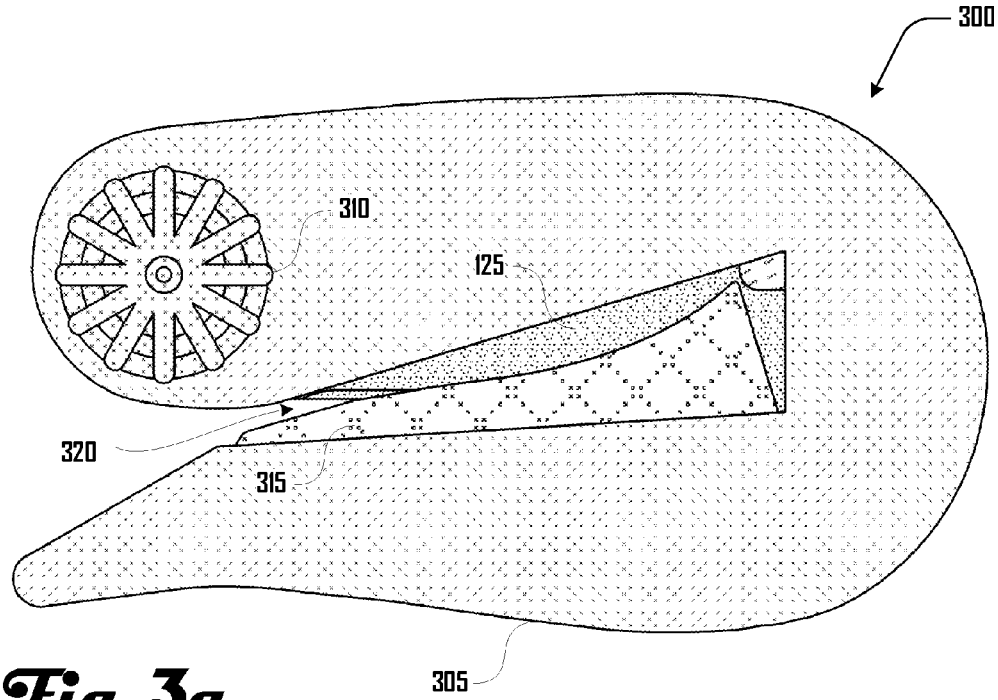
FIG. 3*a* is a diagram of another variable pressure cutting device in accordance with various embodiments.

FIG. 3*a* is a pictorial diagram of an alternate implementation of a variable pressure cutting device 300, in accordance with various embodiments, which includes the device architecture 305 coupled with a blade 125 and a pressure body 315. As shown in FIG. 3*a* the cutting device 300 also includes a cutter slot 320, which is defined by the blade 125 and the pressure body 315.

Figure 3B:
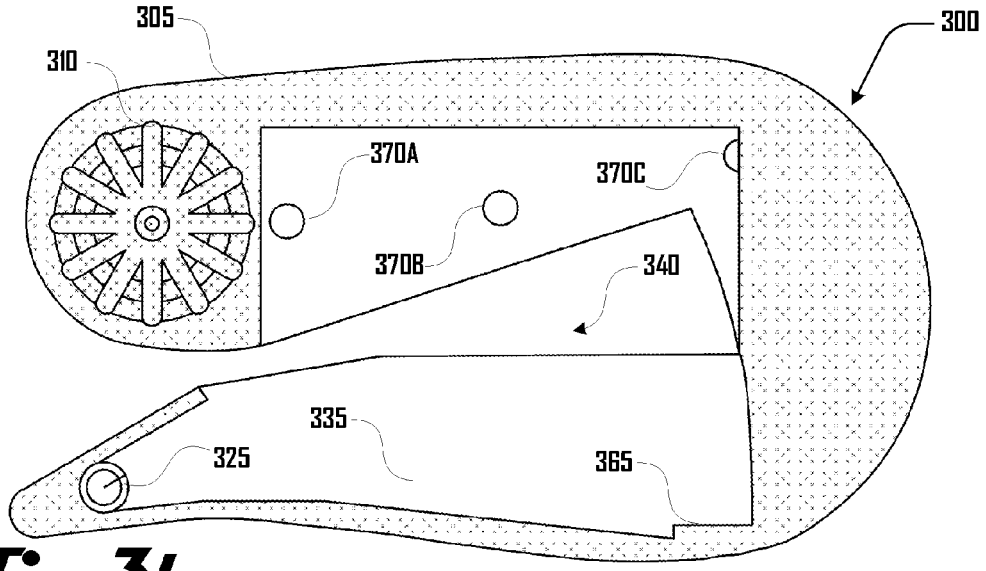
FIG. 3*b* is an open body diagram of a pressure body in accordance with various embodiments.

FIG. 3*b* is an open body cross section depiction of the variable pressure cutting device 300 in accordance with various embodiments. The pressure cutting device 300 as shown in FIG. 3*b* includes a device architecture 305, a grip 310, a pressure body axle 325, a cavity lower portion 335, a cavity upper wall 340, a lip 365, and a plurality of blade pins 370. As shown in FIG. 3*b*, the device architecture defines the lower and upper cavity portion 335, 340.

Figure 3C:
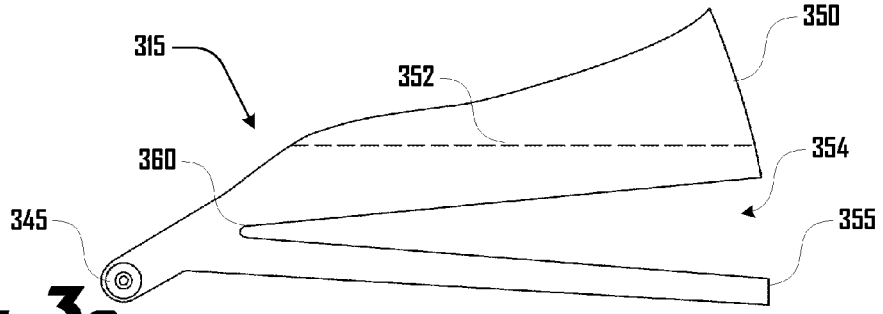
FIG. 3*c* is a pictorial diagram of a variable pressure cutting device pressure body, in accordance with various embodiments.
Figure 3D:
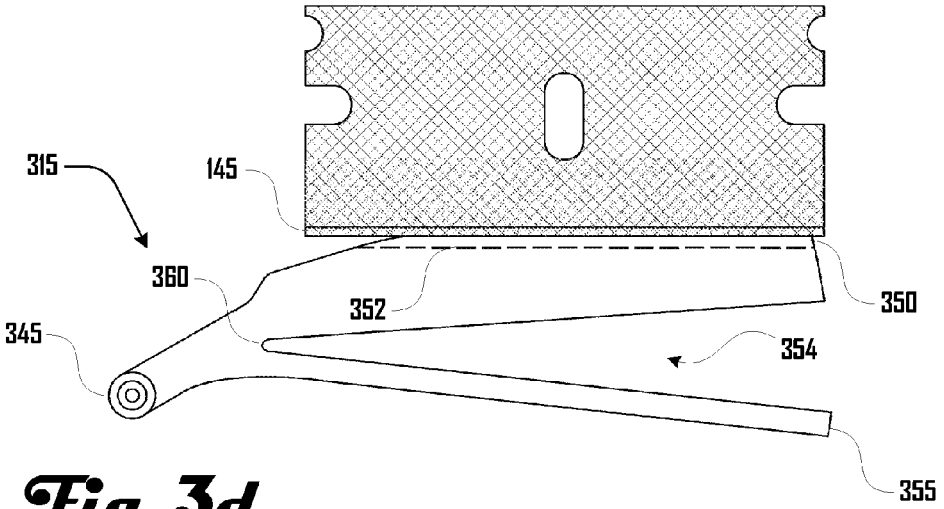
FIG. 3*d* is a diagram of a pressure body coupled with a blade in accordance with various embodiments.

FIG. 3*c* is a diagram of a pressure body 315 in accordance with various embodiments. The pressure body 315 comprises an axle pin 345, an upper arm 350, a lower arm 355, and a flex region 360. The upper arm 350 includes a blade slot 352. FIG. 3*d* is a cut-away diagram of a pressure body 315 with a blade positioned in the blade slot 352 in accordance with various embodiments. In some embodiments, the blade slot 352 may be a slot defined by the upper arm 350, however, in some embodiments, the blade slot 352 may be a relief portion of the upper arm 350.

Figure 3E:
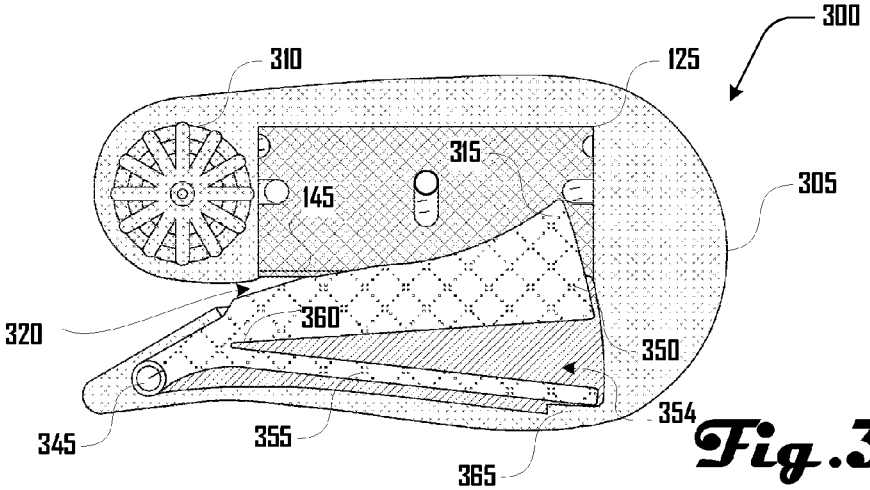
FIG. 3*e* is a cross section diagram of a variable pressure cutting device in a first cutting position, in accordance with various embodiments.
Figure 3F:
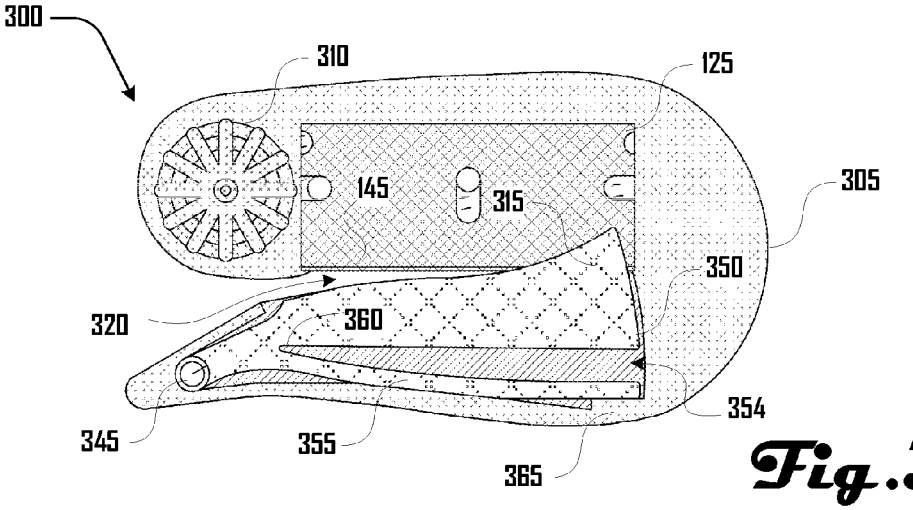
FIG. 3*f* is a cross section diagram of a variable pressure cutting device in a second cutting position, in accordance with various embodiments.
Figure 3G:
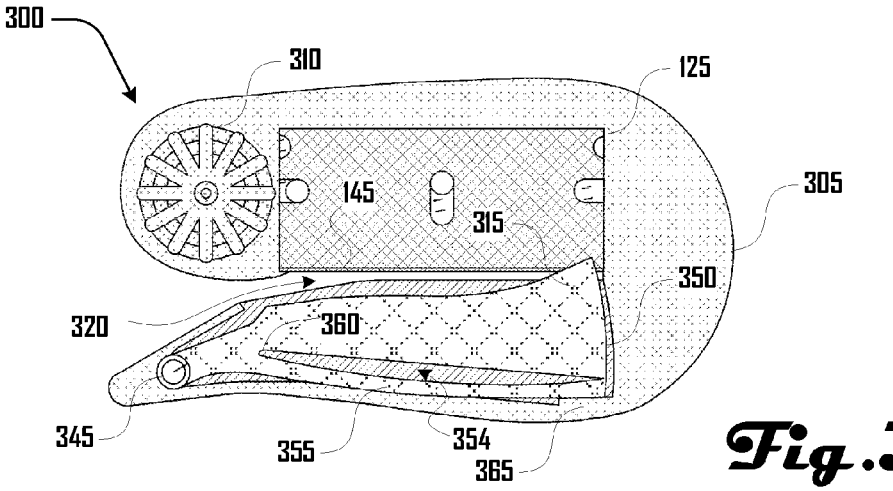
FIG. 3*g* is a cross section diagram of a variable pressure cutting device in a third cutting position, in accordance with various embodiments.

FIGS. 3*e*, 3*f*, and 3*g* depict a cross section of a variable pressure cutting device 300 in a first, second, and third cutting position, in accordance with various embodiments. Specifically, FIGS. 3*e*, 3*f*, and 3*g* depict the pressure body 315 in increasingly compressed configurations, which results in further rearward elongation of the cutter slot 320.

For example, FIG. 3*e* depicts the pressure body 315 in a first or neutral configuration. In such an exemplary configuration, the pressure body 315 may not be under force from a substrate 190 being cut in the cutter slot 320 or force from a substrate 190 in the cutter slot 320 may be insufficient to cause flexing of the pressure body 315 about a flex region 360.

In FIGS. 3*f* and 3*g*, configurations are depicted wherein the pressure body 315 flexes, bends or deforms about a flex region in response to the force associated with a substrate 190 being inserted into the cutter slot 320. Additionally, in various embodiments, and in various configurations, flexing, bending or deformation may occur in other portions of the pressure body 315, including the upper arm 350, lower arm 355, and the like. In further embodiments, the pressure body 315 may rotate about the axle pin 345.

In some embodiments, increasing force is required to cause the pressure body 315 to assume subsequent configurations which further rearwardly elongate the cutter slot 320. Such increase in force may be linear, exponential, or variable in some embodiments.

In some embodiments, the pressure body 315 comprises an upper arm 350 and a lower arm 355, the upper and lower pressure arm being joined at a flex region 360 and extending therefrom. The upper and lower pressure arm 350, 355 may extend substantially in the same direction, and may define an upper-lower pressure arm slot 354.

Figure 4A:
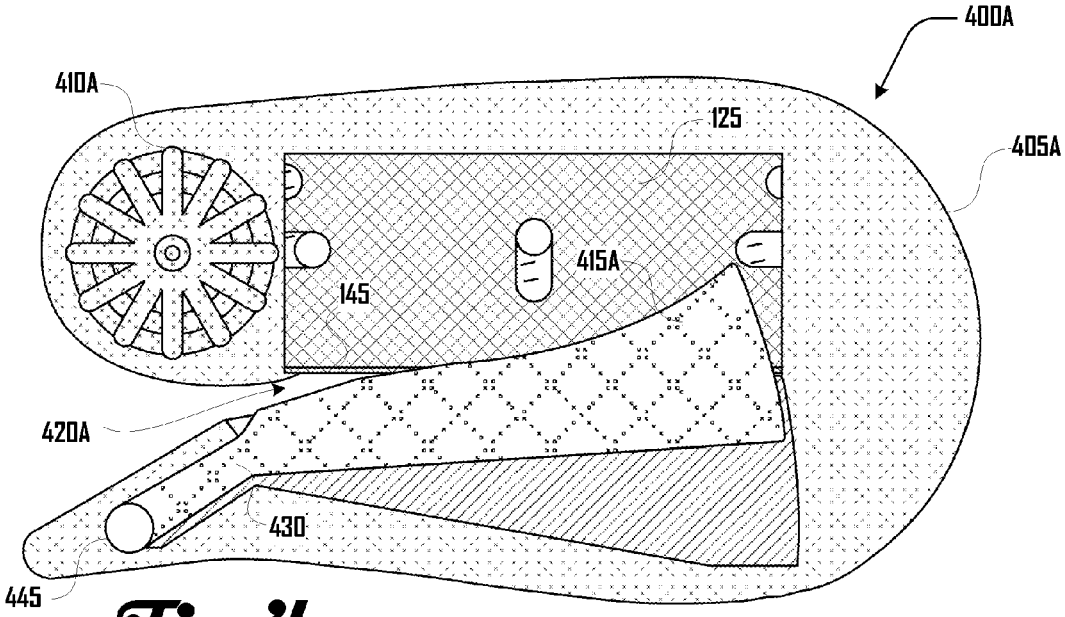
FIG. 4*a* is a cross section diagram of a further variable pressure cutting device, in accordance with various embodiments.
Figure 4B:
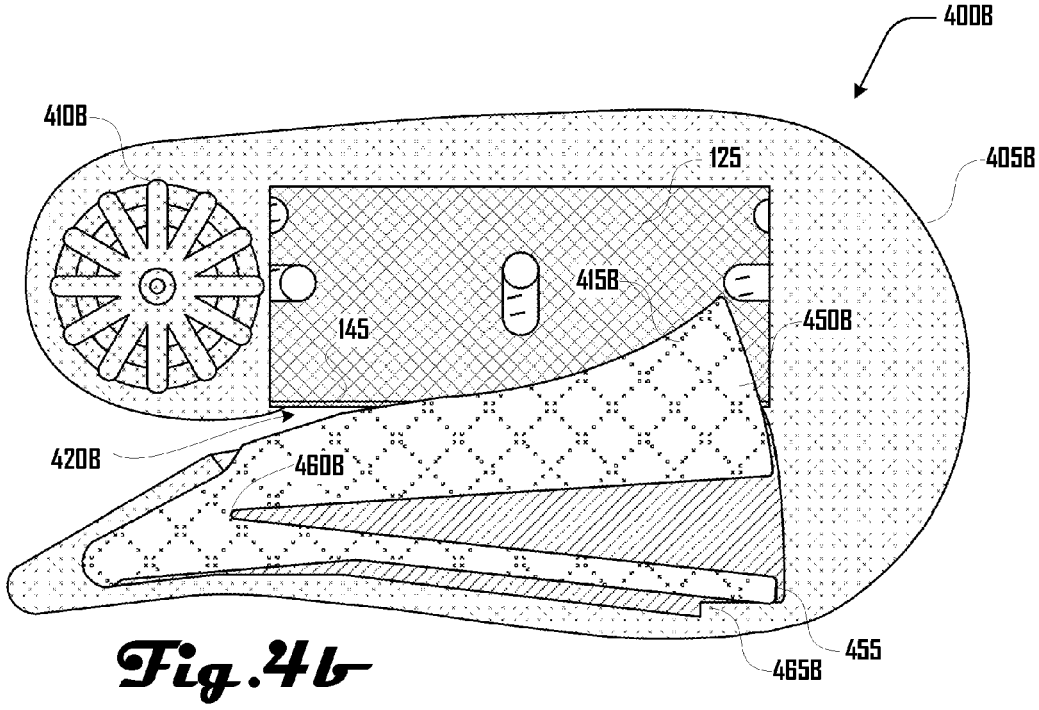
FIG. 4*b* is a cross section diagram of a yet another variable pressure cutting device, in accordance with various embodiments.
Figure 4C:
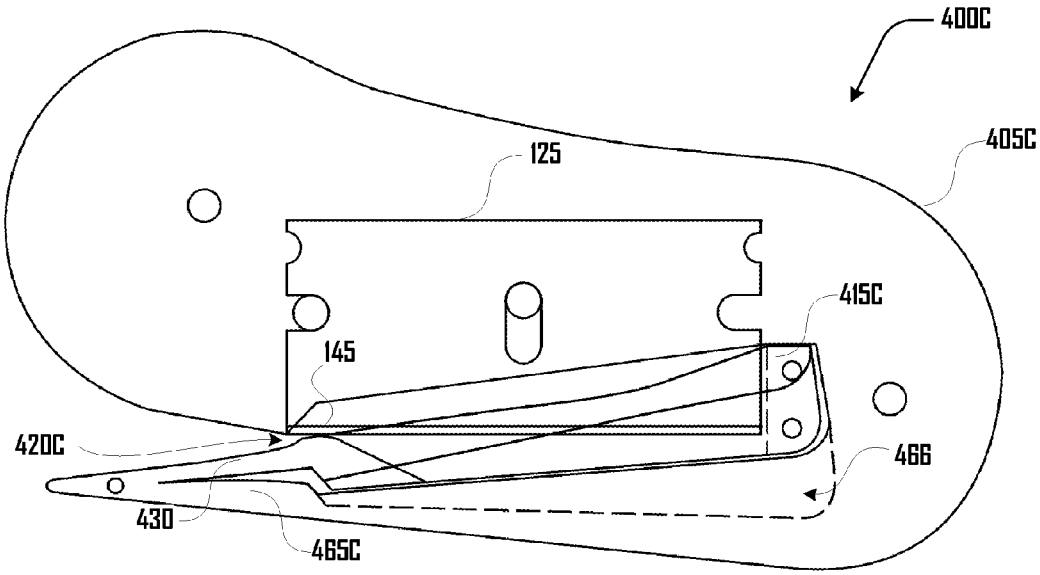
FIG. 4*c* is a cross section diagram of a still further variable pressure cutting device, in accordance with various embodiments.

FIGS. 4*a*, 4*b* and 4*c* depict a cross section diagram of further embodiments of a variable pressure cutting device 400A, 400B, 400C in accordance with various embodiments. For example, depicted in FIG. 4A is a variable pressure cutting device 400A having a pressure body 415A that comprises an axle 445 and a single pressure arm 415A instead of an upper and lower arm 350, 355 as in some embodiments. Furthermore, the cutting device 400A also includes a device architecture 405A that holds a blade 125 and has a grip 410A.

FIG. 4B depicts a variable pressure cutting device 400B wherein a pressure body 415B comprises upper and lower arms 450B, 455, and the pressure body 415B is coupled to the device architecture 405B via entrapment, friction, an adhesive, welding, or the like, as compared to an axle pin 345 or other structure. As in other embodiments, the cutting device 400B comprises a grip 410B, a lip 465B and a cutter slot defined by the upper arm 450B of the pressure body 415B and the edge 145 of a blade 125.

In further embodiments, a pressure body 315, 415A, 415B as described herein may be an integral portion of the device architecture 305, 405A, 405B instead of being a separate piece. For example, FIG. 4*c* depicts a variable pressure cutting device 400C wherein a pressure body 415C is an integral portion of the device architecture 405C. As shown in FIG. 4*c*, the pressure body 415C flexes or bends at least at a flex portion 430, and variable pressure may be generated by the flex portion 430 or other portions of the pressure body 415C contacting a lip 465C of the device architecture 405C. Additionally, as depicted in FIG. 4, the front extended nose portion of the device architecture 405C may be pointed like an awl. In further embodiments, a front extended nose portion of a device architecture 305, 405 may take on various shapes, and may similarly do so in any embodiment described herein.

In an embodiment, the pressure body 415C comprises a single elongated member extending from a portion of the device architecture at a flex portion 430, the flex portion 430 operable to deform in response to a substrate pressing against the pressure body 415C at the second pressure. The flex portion 430 may have a smaller width than the width of the portion of the pressure body 415C extending therefrom. The pressure body 415C may be operable to increasingly move into a pressure cavity 466 defined by the device architecture 405C as the cutter slot 420C opens rearwardly. In some embodiments, the flex portion 430 may flex against a portion of the device architecture 405A, 405C. Such a portion may be pointed, rounded, planar, or any other suitable configuration.

In an embodiment, the pressure body 415C comprises a single elongated member extending from a portion of the device architecture at a flex portion 430, the flex portion 430 operable to deform in response to a substrate pressing against the pressure body 415 at the second pressure. The flex portion 430 may have a smaller width than the width of the portion of the pressure body 415 extending therefrom. The pressure body 415 may be operable to increasingly move into a pressure cavity 466 defined by the device architecture 405C as the cutter slot 420C opens rearwardly. In some embodiments, the flex portion 430 may flex against a portion of the device architecture 405A, 405C. Such a portion may be pointed, rounded, planar, or any other suitable configuration.

Figure 5A:
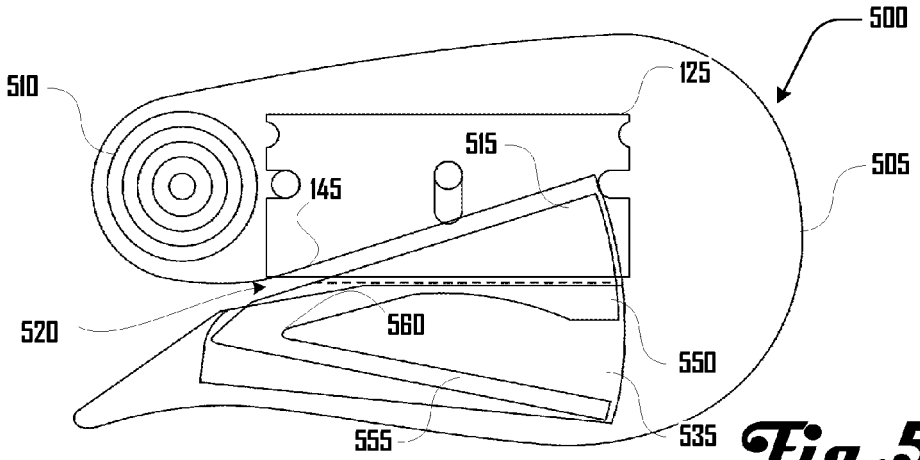
FIG. 5*a* is a cross section diagram of a variable pressure cutting device in a first cutting position, in accordance with various embodiments.
Figure 5B:
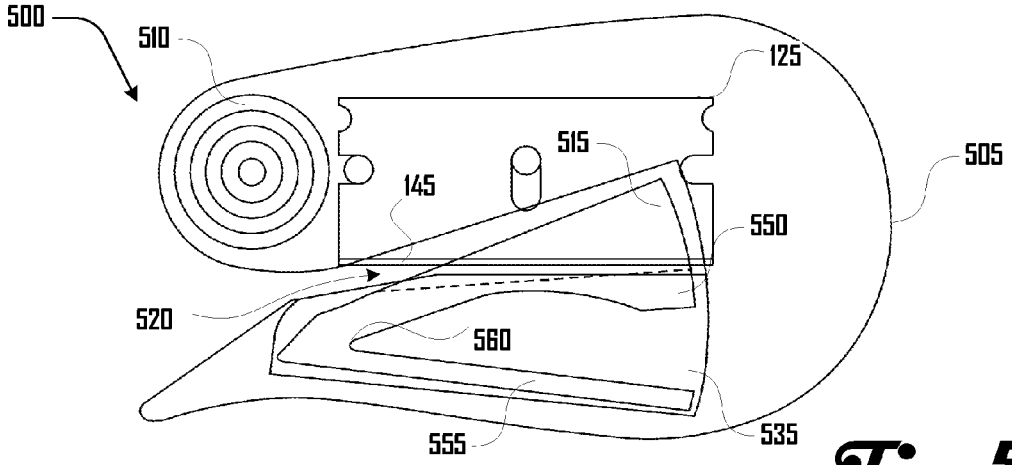
FIG. 5*b* is a cross section diagram of a variable pressure cutting device in a second cutting position, in accordance with various embodiments.
Figure 5C:
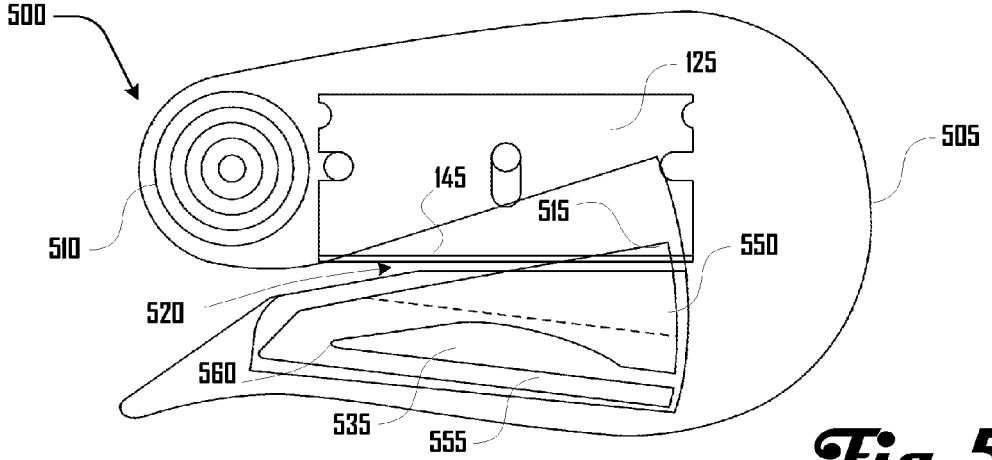
FIG. 5*c* is a cross section diagram of a variable pressure cutting device in a third cutting position, in accordance with various embodiments.

FIGS. 5*a*, 5*b*, and 5*c* depict a cross section of a variable pressure cutting device 500 in a first, second, and third cutting position, in accordance with various embodiments. Specifically, FIGS. 5*a*, 5*b*, and 5*c* depict the pressure body 515 in increasingly compressed configurations, which results in further rearward elongation of the cutter slot 520.

For example, FIG. 5*a* depicts the pressure body 515 in a first or neutral configuration. In such an exemplary configuration, the pressure body 515 may not be under force from a substrate being cut in the cutter slot 520 or force from a substrate in the cutter slot 520 may be insufficient to cause flexing of the pressure body 515 about a flex region 560, or cause downward movement of the pressure body.

FIG. 5*b* depicts a second configuration wherein the pressure body 515 is forced downward into the cavity 535 by the force of a substrate being inserted into the cutter slot 520. In such a configuration, the pressure body 515 may contact a portion of the device architecture 505 that defines the cavity 535 to oppose force applied by a substrate and allow the device 500 to assume further configurations such as the configuration depicted in FIG. 5*c*.

FIG. 5*c* depicts a configuration wherein the pressure body 515 flexes, bends or deforms about a flex region 560 in response to the force associated with a substrate being inserted into the cutter slot 520. In further embodiments, the upper arm 550 may be bent such that it contacts the lower arm 555. Accordingly, in various embodiments, and in various configurations, flexing, bending or deformation may occur in other portions of the pressure body 515, including the upper arm 550, lower arm 555, and the like.

In some embodiments, increasing force is required to cause the pressure body 515 to assume subsequent configurations which further rearwardly elongate the cutter slot 520. Such increase in force may be linear, exponential, or variable in some embodiments.

Figure 6A:
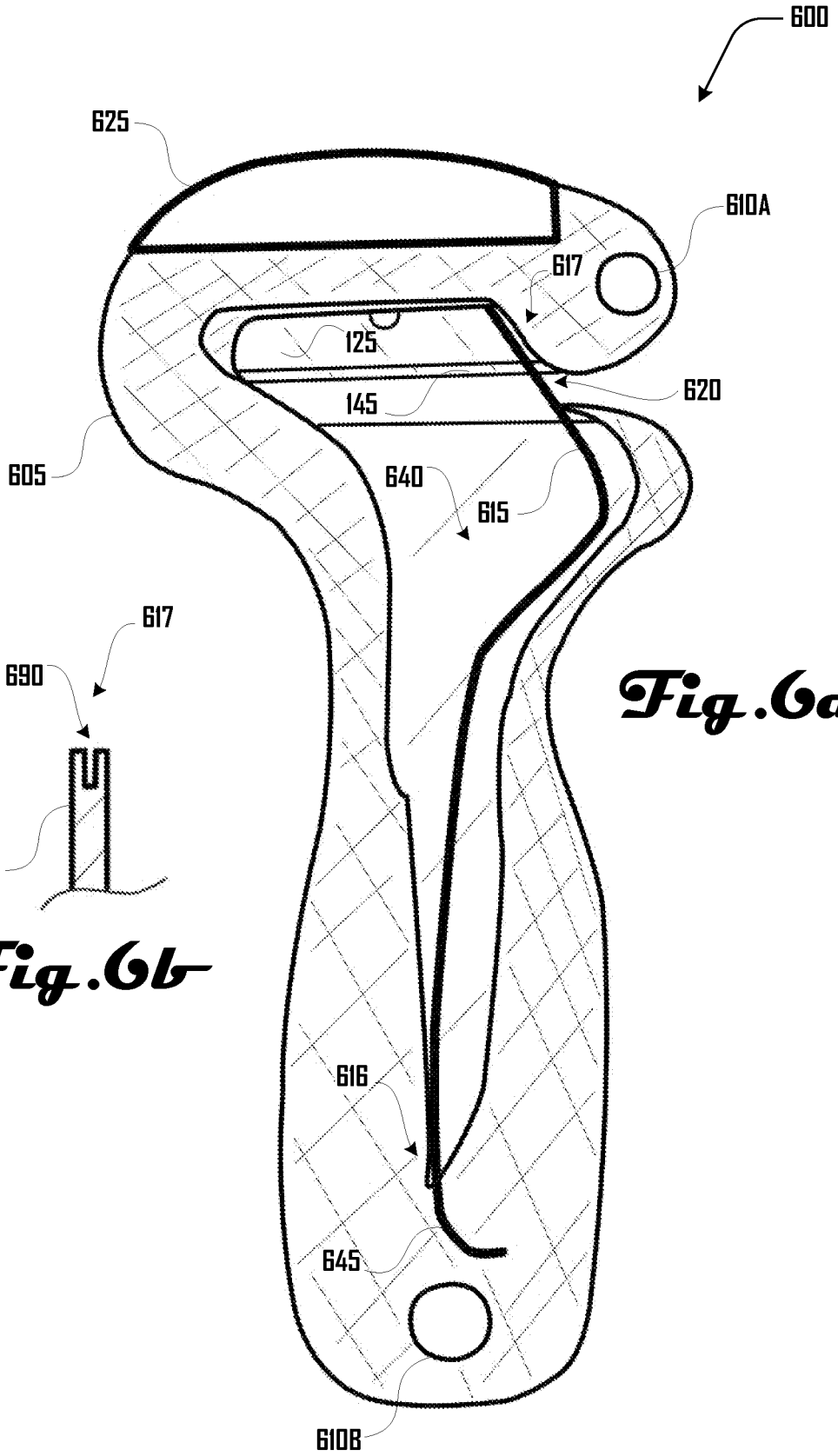
FIG. 6*a* is a cross section diagram of a still further variable pressure cutting device, in accordance with various embodiments.
Figure 6B:
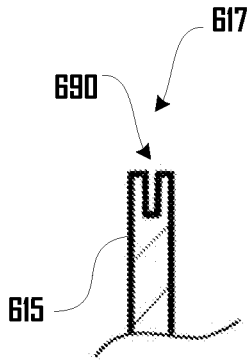
FIG. 6*b* is a close-up view of a pressure arm in accordance with various embodiments.

FIG. 6*a* is a cross section diagram of a still further variable pressure cutting device 600, in accordance with various embodiments. The variable pressure cutting device 600 comprises a device architecture 605, a first and second orifice 610A, 610B, a blade 125 a pressure body 615, a cutter slot 620, a cap 625, a pressure cavity 640, and an anchor slot 645. The cutter slot 620 is defined by an edge 145 of the blade 125, and the pressure body 615. Additionally, as depicted in FIG. 6*b*, the pressure body 615 comprises a blade slot 690, which is operable to accept the blade 125 therewithin.

As depicted in FIG. 6*a*, the device architecture 605 defines a pressure cavity 640 and an anchor slot 645. The anchor slot 645 is configured to hold or anchor the pressure body 615 and allow the pressure body 615 to move and flex within the pressure cavity 640 as described herein. In various embodiments, the blade 125 may be replaceable, and such replacement may be achieved by removal of the cap 625. The cap 625 may be removably coupled to the device architecture 605 in various ways.

Figure 6C:
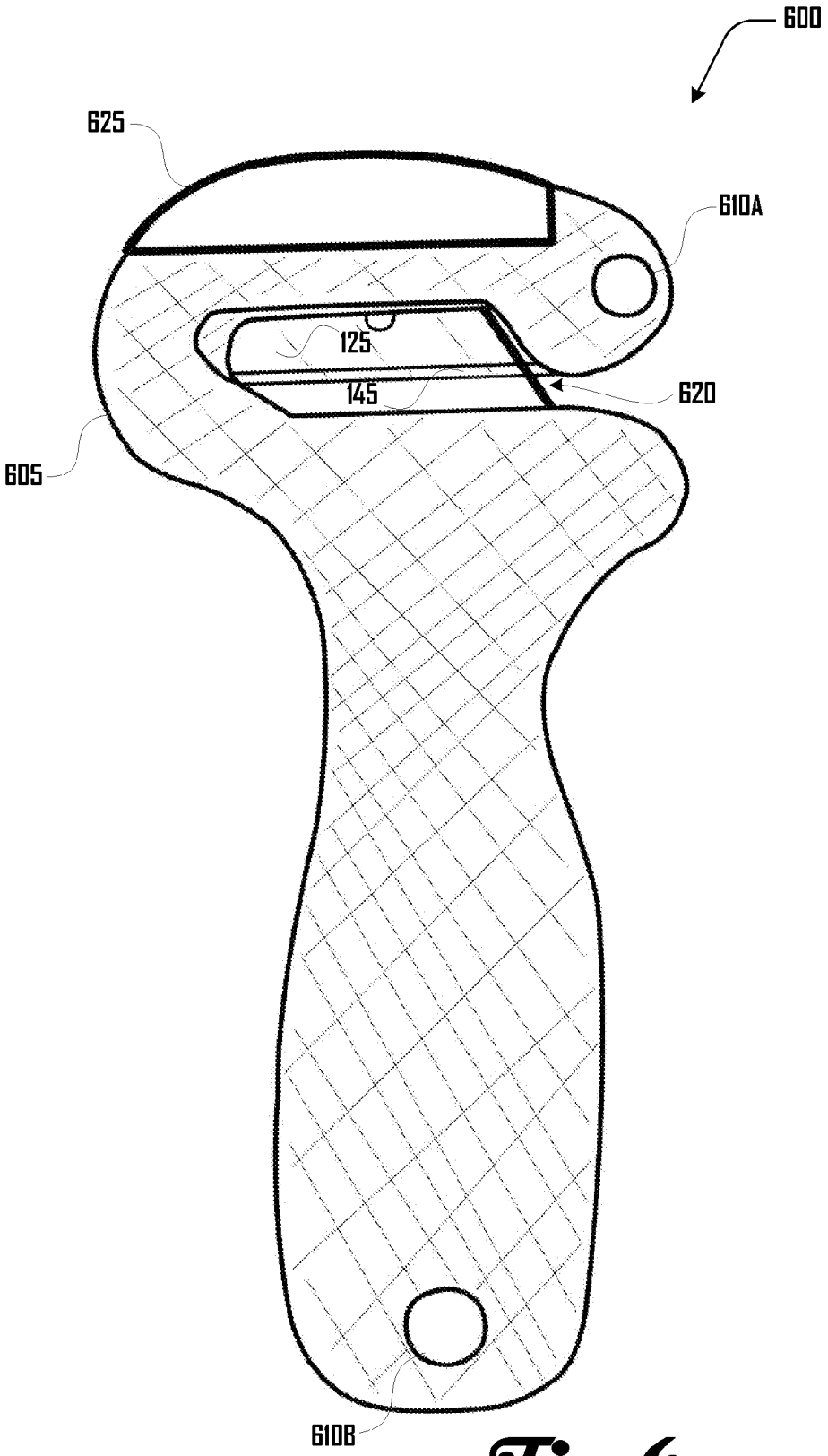
FIG. 6*c* is a diagram of a variable pressure cutting device, in accordance with various embodiments.

FIG. 6*c* is a diagram of a variable pressure cutting device 600, in accordance with various embodiments, which illustrates that in various embodiments, the pressure cavity 640 and pressure body 615 are enclosed.

Figure 6D:
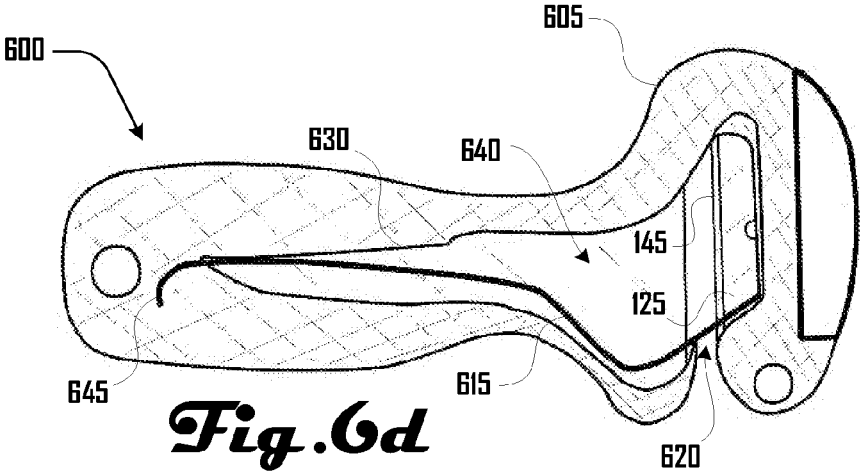
FIG. 6*d* is a cross section diagram of a variable pressure cutting device in a first cutting position, in accordance with various embodiments.
Figure 6E:
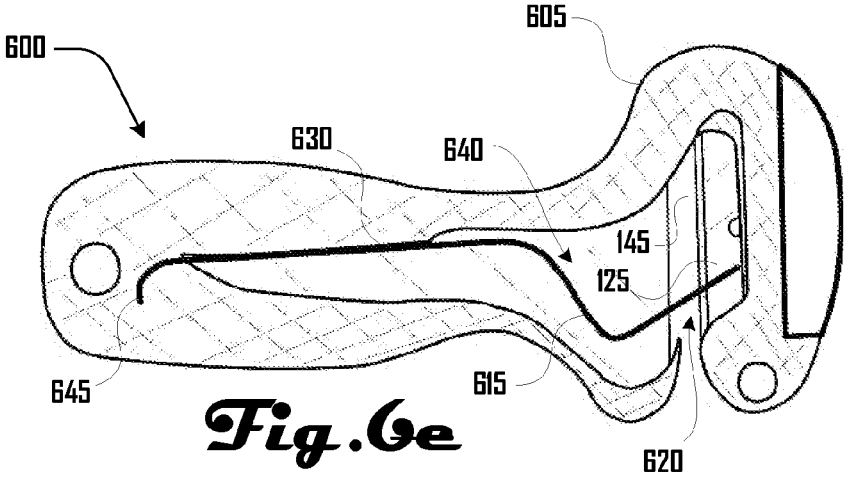
FIG. 6*e* is a cross section diagram of a variable pressure cutting device in a second cutting position, in accordance with various embodiments.
Figure 6F:
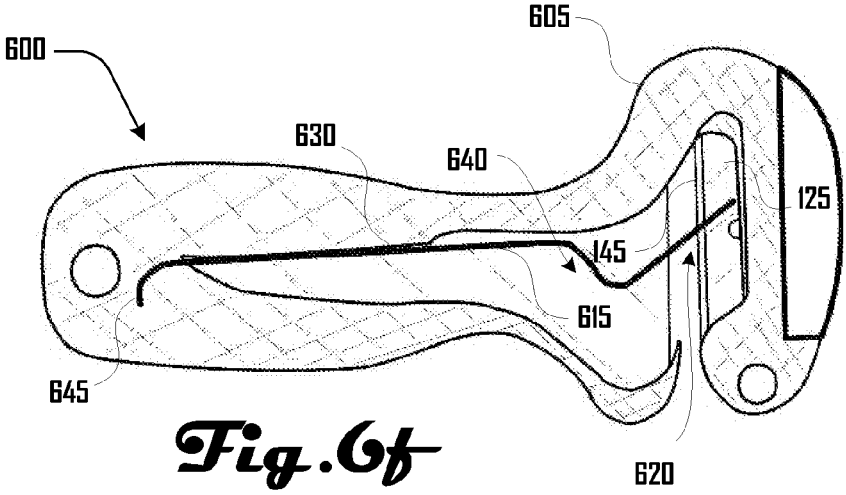
FIG. 6*f* is a cross section diagram of a variable pressure cutting device in a third cutting position, in accordance with various embodiments.

FIGS. 6*d*, 6*e* and 6*f* depict various configurations of the pressure body 615 within the pressure cavity 640. Specifically, FIGS. 6*d*, 6*e* and 6*f* depict various configurations of the pressure body 615 flexing, bending or deforming in response to a substrate 190 being cut within the cutter slot 620.

For example, FIG. 6*d* depicts a first or neutral position of the pressure body 615, which is a configuration in which the pressure body 615 is not under force from a substrate 190 in the cutter slot 620. While some substrates 190 may be cut within the cutter slot 620 by the resting pressure of the pressure body 615, the cutting of other substrates 190 may require additional pressure, which may cause the pressure body 615 to flex or bend rearwardly into the pressure cavity 640 as shown in FIGS. 6*e* and 6*f*.

In various embodiments, the pressure body 615 may be a flexible elongated strip, which is operable to flex as shown in FIGS. 6*d*, 6*e* and 6*f*. For example, the pressure body 615 may be metal, plastic, and the like. In various embodiments, the bending or flexing of the pressure body 615 may generate increasing force against a substrate 190, causing such bending or flexing. Such increasing force may be linear, exponential, variable, a combination thereof, and the like. For example, as shown in FIGS. 6*d*-6*f*, the device architecture 605 may include various wall shapings such as an extension 630, which generates variable pressure as the pressure body 615 contacts portions of the extension 630. Accordingly, the extension 630 may modify the point of flex of the pressure body 615 as the pressure body 615 contacts various portions of the extension 630 as the pressure body 615 flexes rearwardly.

In an embodiment, the pressure body 615 extends from a portion of the device architecture 605 at a pressure body first end 616 and a pressure body second end 617 defines the cutter slot 620.

Figure 7A:
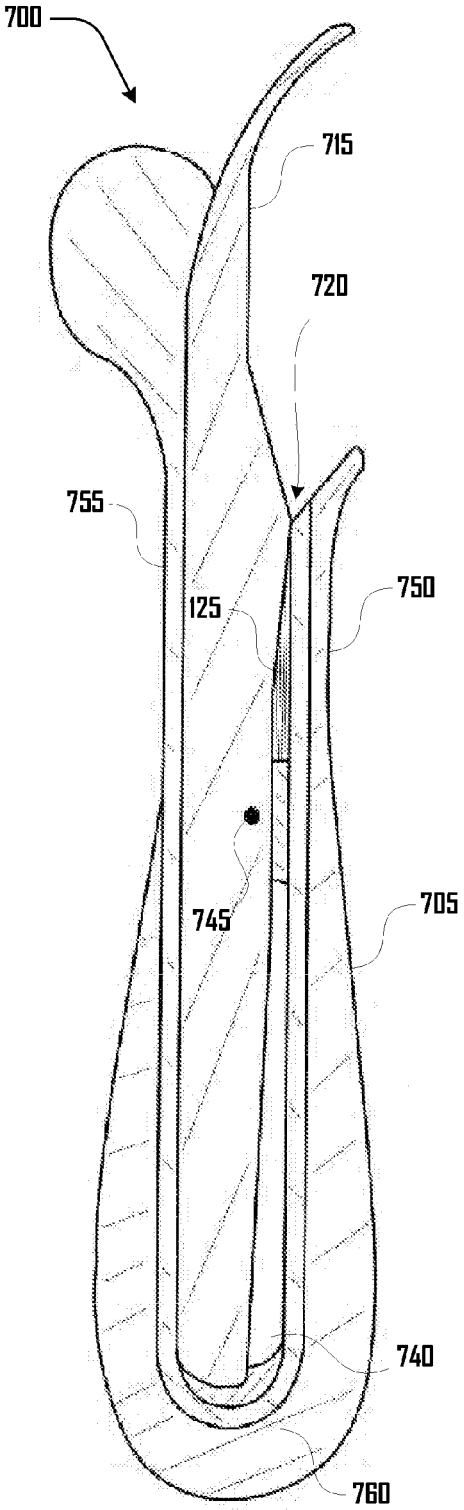
FIG. 7*a* is a side view of another variable pressure cutting device in a first cutting position, in accordance with various embodiments.
Figure 7B:
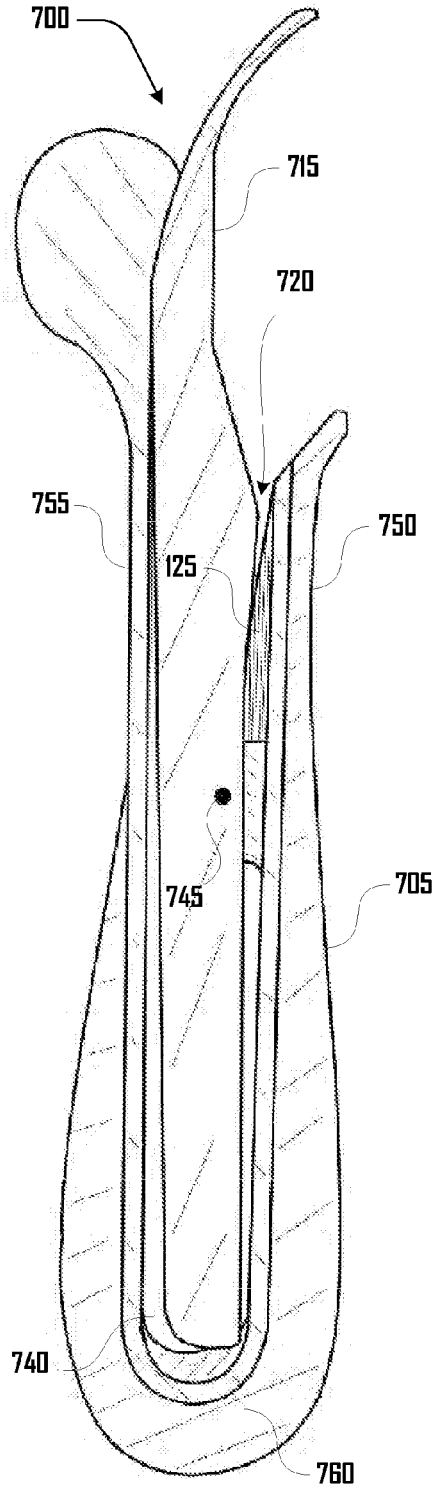
FIG. 7*b* is a side view of another variable pressure cutting device in a second cutting position, in accordance with various embodiments.

FIGS. 7*a* and 7*b* depict a side view of another variable pressure cutting device 700 in a first and second cutting position, in accordance with various embodiments. The variable pressure cutting device 700 includes a device architecture 705, a pressure body 715, a cutter slot 720, a pivot 745, and a flex region 760. The cutter slot 720 is defined by a blade 125 and a portion of the pressure body 715. The device architecture 705 comprises an upper arm 750 and a lower arm 755.

As depicted in FIGS. 7*a* and 7*b*, the device architecture 705 encircles the pressure body 715, defining a pressure cavity 740, and the pressure body 715 is rotatably coupled to a portion of the upper arm 750 via a pivot 745. Accordingly, the pressure body 715 may rotate about the pivot 745 within the pressure cavity 740.

In various embodiments, a substrate 190 may be cut by inserting the substrate 190 into the cutter slot 720, whereby the substrate 190 is cut between the blade 125 and the pressure body 715. For thick substrates 190 or substrates 190 requiring substantial force for cutting, the upper arm 750 is operable to flex upward about the flex region 760, and thereby widen the cutter slot 720. Additionally, as the upper arm 750 flexes upward, the pressure body 715 can rotate about the pivot 745 to facilitate further opening of the cutter slot 720 and to supply cutting pressure to the substrate 190.

Figure 8A:
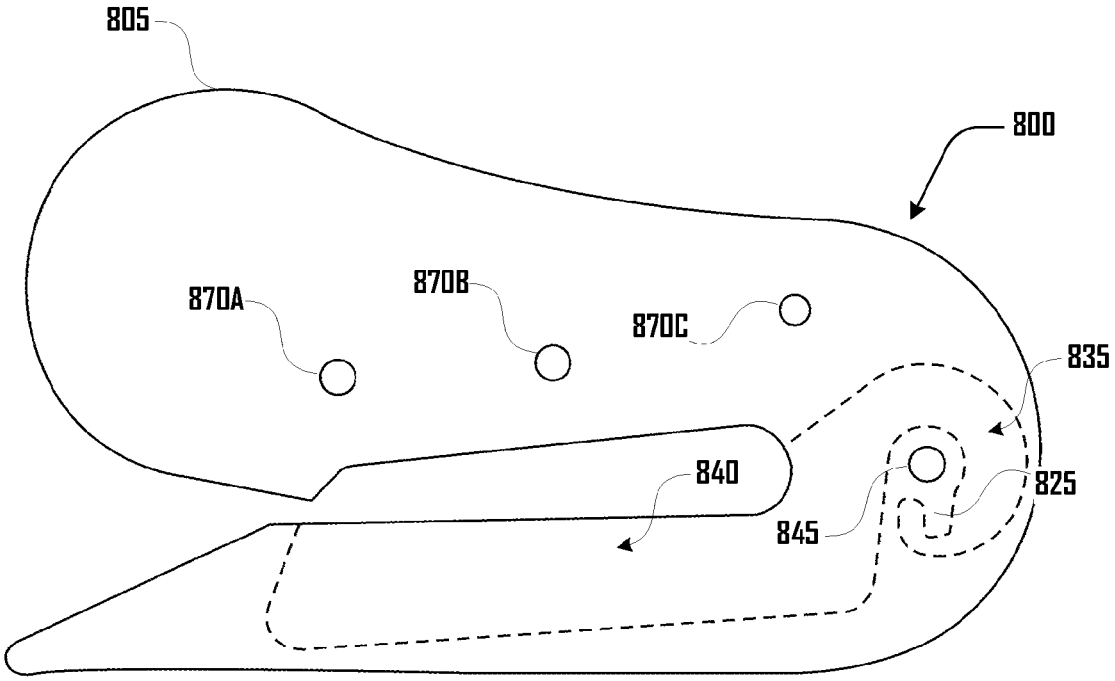
FIG. 8*a* is an open body diagram of a pressure body in accordance with various embodiments.

FIG. 8*a* is an open body cross section depiction of a variable pressure cutting device 800 in accordance with various embodiments. The pressure cutting device 800 as shown in FIG. 8*a* includes a device architecture 805, having a spring arm mandrel 845 with a spring arm coupling extension 825, and a plurality of blade pins 870A, 870B, 870C. As shown in FIG. 8*a*, the device architecture 805 defines a main cavity portion 840, and a spring cavity 835.

Figure 8B:
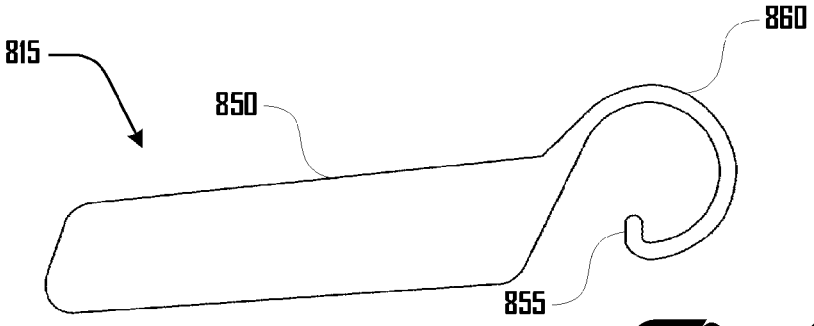
FIG. 8*b* is a pictorial diagram of a variable pressure cutting device pressure body, in accordance with various embodiments.
Figure 8C:
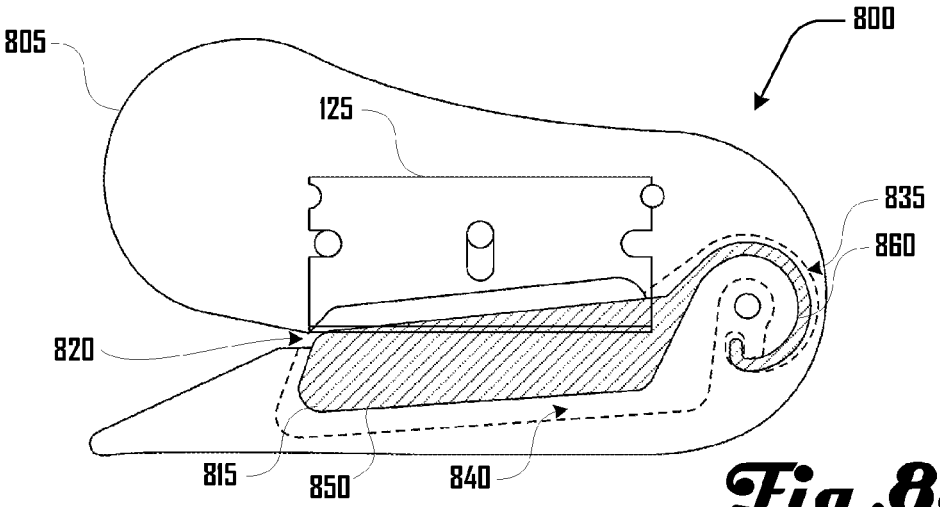
FIG. 8*c* is a cross section diagram of a variable pressure cutting device in a first cutting position, in accordance with various embodiments.
Figure 8D:
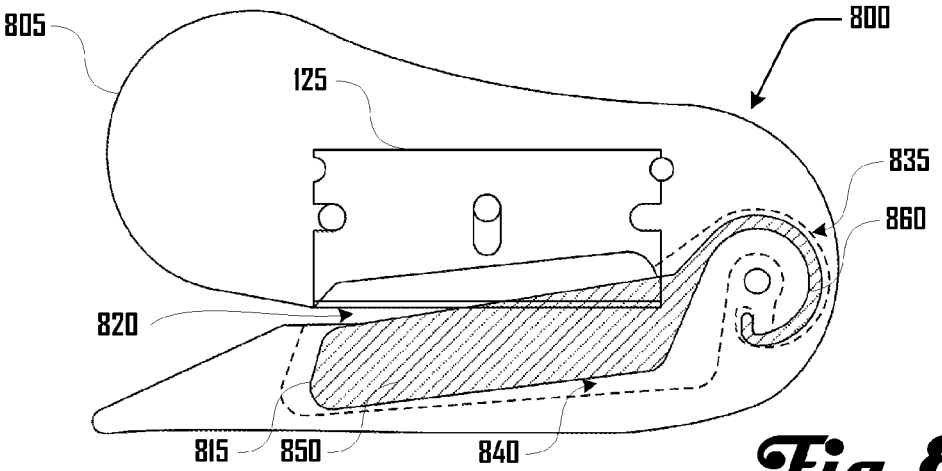
FIG. 8*d* is a cross section diagram of a variable pressure cutting device in a second cutting position, in accordance with various embodiments.
Figure 8E:
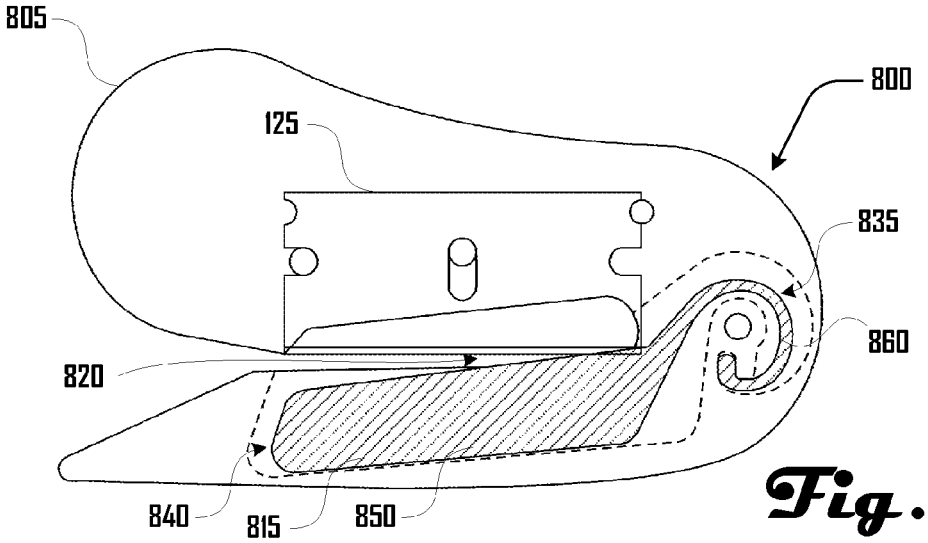
FIG. 8*e* is a cross section diagram of a variable pressure cutting device in a third cutting position, in accordance with various embodiments.

FIG. 8*b* is a diagram of a pressure body 815 in accordance with various embodiments. The pressure body 815 comprises a pressure arm 850, a spring arm 860, and a coupling nub 855. As depicted in FIGS. 8*c*, 8*d*, and 8*e*, the pressure body 815 resides within the main cavity portion 840 and spring cavity 835, and couples with the device architecture 805 via the spring arm coupling extension 825. More specifically, the spring arm 860 resides within the spring cavity 835 and the coupling nub 855 couples to the spring arm mandrel 845 by residing within a notch defined by the spring arm coupling extension 825.

FIGS. 8*c*, 8*d*, and 8*e* depict a cross section of a variable pressure cutting device 800 in a first, second, and third cutting position, respectively, in accordance with various embodiments. Specifically, FIGS. 8*c*, 8*d*, and 8*e* depict the pressure body 815 in increasingly compressed configurations, which results in further rearward elongation of the cutter slot 820.

For example, FIG. 8*c* depicts the pressure body 815 in a first or neutral configuration. In such an exemplary configuration, the pressure body 815 may not be under force from a substrate being cut in the cutter slot 820 or force from a substrate in the cutter slot 820 may be insufficient to cause flexing of the pressure body 815 about the spring arm 860, or cause downward movement of the pressure body 815.

FIG. 8*d* depicts a second configuration wherein the pressure arm 850 is forced downward into the cavity 840 by the force of a substrate being inserted into the cutter slot 820. In such a configuration, the pressure arm 850 may contact a portion of the device architecture 805 that defines the main cavity 840 to oppose force applied by a substrate and allow the device 800 to assume further configurations such as the configuration depicted in FIG. 8*e*.

FIG. 8*e* depicts a configuration wherein the pressure arm 850 is forced further downward into the cavity 840 by the force of a substrate being inserted into the cutter slot 820. In such a configuration, the pressure arm 850 may further contact a portion of the device architecture 805 that defines the main cavity 840 to oppose force applied by a substrate. For example, as shown in FIG. 8*e*, the entire lower edge of the pressure arm 850 is contacting a portion of the device architecture 805 that defines the main cavity 840.

In various embodiments, pressure to oppose force applied in the cutter slot 820 may be generated by flexing of the spring arm 860, and in various configurations may be further generated by the spring arm 860 contacting a portion of the spring arm mandrel 845. Additionally, the further embodiments, the spring arm 860 may be other shapes and sizes. As described herein, a variable pressure cutting device 100, 200, 300, 400, 500, 600, 700, 800 may comprise various materials, which may include various plastics, metals, wood, composite materials, and the like.

Additionally, in various embodiments depicted and described herein, a razor blade resides within a slot of a pressure arm or spring arm in some positions of a cutting device. However, in some embodiments, the pressure arm or spring arm may be parallel with the razor blade and move parallel to the razor blade in various configurations of the cutting device instead of residing within a slot. In some embodiments, an industry standard razor blade may be used, and a variable pressure cutting device 100, 200, 300, 400, 500, 600, 700, 800 may be configured to hold at least one design of industry standard razor blade. In an embodiment, the razor blade may be removable.

Additionally, although specific embodiments have been illustrated and described herein, it will be appreciated by those of ordinary skill in the art and others, that a wide variety of alternate and/or equivalent implementations may be substituted for the specific embodiments shown and described without departing from the scope of the embodiments described herein. This application is intended to cover any adaptations or variations of the embodiments discussed herein. While various embodiments have been illustrated and described, as noted above, many changes can be made without departing from the spirit and scope of the embodiments described herein.

The invention claimed is:

1. A cutting device comprising:

a blade;

a device architecture configured to hold the blade comprising:

a pressure body comprising a spring extension and operable to remain rigid in response to a substrate pressing against a portion of the pressure body at a first pressure, and a portion of the pressure body operable to deform in response to the substrate pressing against a portion of the pressure body at a second pressure, and thereby provide variable resistance against the substrate; and a cutter slot at a first device architecture end defined by the blade and a pressure arm of the pressure body, the cutter slot configured to receive the substrate and operable to open rearwardly toward a second end as the pressure body deforms;

wherein the spring extension extends from a portion of the device architecture at a first spring extension end in a first direction;

wherein the pressure arm extends from a second spring extension end in a second direction substantially opposite from the first direction; and wherein the spring extension and the pressure arm define a pressure body slot; and wherein the cutter slot is defined within the pressure body slot.

2. The cutting device of claim 1, wherein the spring extension is operable to deform in response to the substrate pressing against the portion of the pressure body at the second pressure.

3. The cutting device of claim 1, wherein the pressure arm is operable to move in response to the substrate pressing against the portion of the pressure body at the second pressure.

4. The cutting device of claim 3, wherein the pressure arm is operable to move into a lower cavity defined by the device architecture.

5. The cutting device of claim 1, wherein a portion of the pressure body resides within an upper cavity defined by the device architecture, and wherein a portion of the pressure body is operable to contact a portion of the device architecture defining the upper cavity as the pressure body deforms and thereby provide further variable resistance to the substrate.

6. The cutting device of claim 1, wherein a portion of the pressure body is operable to reside within an lower cavity defined by the device architecture, and wherein a portion of the pressure body is operable to contact a portion of the device architecture defining the lower cavity as the pressure body deforms and thereby provide further variable resistance to the substrate.

7. The cutting device of claim 1, wherein the pressure body is contiguously formed from the device architecture.

8. The cutting device of claim 1, wherein the pressure body is a discrete body held within a portion of the device architecture.

9. The cutting device of claim 1, wherein the pressure body defines a blade slot, wherein a portion of the blade is operable to reside therein.

10. The cutting device of claim 1, wherein the blade is removable from the device architecture.

* * * * *